US011837424B2

(12) United States Patent
Hoffmann et al.

(10) Patent No.: US 11,837,424 B2
(45) Date of Patent: Dec. 5, 2023

(54) CONTACT ARRANGEMENT FOR A SWITCHING DEVICE AND SWITCHING DEVICE

(71) Applicant: TDK Electronics AG, Munich (DE)

(72) Inventors: Robert Hoffmann, Berlin (DE); Robert Minkwitz, Berlin (DE)

(73) Assignee: TDK Electronics AG, Munich (DE)

( * ) Notice: Subject to any disclaimer, the term of this patent is extended or adjusted under 35 U.S.C. 154(b) by 187 days.

(21) Appl. No.: 17/436,538

(22) PCT Filed: Mar. 5, 2020

(86) PCT No.: PCT/EP2020/055867
§ 371 (c)(1),
(2) Date: Sep. 3, 2021

(87) PCT Pub. No.: WO2020/187586
PCT Pub. Date: Sep. 24, 2020

(65) Prior Publication Data

US 2022/0139655 A1 May 5, 2022

(30) Foreign Application Priority Data

Mar. 18, 2019 (DE) ..... 102019106832.0

(51) Int. Cl.
*H01H 50/34* (2006.01)
*H01H 50/54* (2006.01)
*H01H 1/20* (2006.01)

(52) U.S. Cl.
CPC ..... *H01H 50/546* (2013.01); *H01H 1/2008* (2013.01); *H01H 50/34* (2013.01)

(58) Field of Classification Search
CPC .... H01H 50/546; H01H 1/2008; H01H 50/34; H01H 50/22; H01H 51/065; H01H 2050/025
See application file for complete search history.

(56) References Cited

U.S. PATENT DOCUMENTS

| | | | | |
|---|---|---|---|---|
| 4,604,597 | A | 8/1986 | Bögner et al. | |
| 7,598,831 | B2 | 10/2009 | Braun et al. | |
| 9,111,705 | B2 | 8/2015 | Schulte | |
| 9,728,360 | B2 | 8/2017 | Birner et al. | |
| 9,754,749 | B2 * | 9/2017 | Son | H01H 50/18 |
| 10,854,406 | B2 | 12/2020 | Bobert | |

(Continued)

FOREIGN PATENT DOCUMENTS

| | | | |
|---|---|---|---|
| CN | 101322208 | A | 12/2008 |
| CN | 202796485 | U | 3/2013 |

(Continued)

*Primary Examiner* — Shawki S Ismail
*Assistant Examiner* — Lisa N Homza
(74) *Attorney, Agent, or Firm* — Slater Matsil, LLP

(57) ABSTRACT

In an embodiment a contact arrangement includes a retaining element with a cylindrical hole having a cylinder axis configured to arrange the retaining element on a shaft and a contact bridge attached to the retaining element, wherein the contact bridge has a top side with at least one contact region and a bottom side opposite the top side, and wherein, via a rotation around the cylinder axis, the contact bridge is transferable to a locked state on the retaining element in a direction along the cylinder axis.

15 Claims, 5 Drawing Sheets

(56) References Cited

U.S. PATENT DOCUMENTS

| | | | | |
|---|---|---|---|---|
| 2014/0002215 | A1* | 1/2014 | Ionescu | H01H 50/18 335/18 |
| 2019/0122831 | A1* | 4/2019 | Bedggood | H01H 3/001 |
| 2020/0402753 | A1 | 12/2020 | Hoffmann et al. | |
| 2023/0132857 | A1* | 5/2023 | Kroeker | H01H 1/365 200/260 |

FOREIGN PATENT DOCUMENTS

| | | | |
|---|---|---|---|
| CN | 104040670 | A | 9/2014 |
| CN | 106067406 | A | 11/2016 |
| DE | 8221714 | U1 | 9/1982 |
| DE | 102004017160 | A1 | 10/2005 |
| DE | 102011080477 | A1 | 2/2013 |
| DE | 102012201967 | A1 | 8/2013 |
| EP | 2442343 | A2 | 4/2012 |
| EP | 3477677 | A1 | 5/2019 |
| FR | 2895143 | A1 | 6/2007 |
| JP | S5935335 | A | 2/1984 |
| JP | 2009519571 | A | 5/2009 |
| KR | 1020160007249 | A | 1/2016 |
| KR | 1020180101553 | A | 9/2018 |
| WO | 2019154855 | A1 | 8/2019 |

* cited by examiner

CONTACT ARRANGEMENT FOR A SWITCHING DEVICE AND SWITCHING DEVICE

This patent application is a national phase filing under section 371 of PCT/EP2020/055867, filed Mar. 5, 2020, which claims the priority of German patent application 102019106832.0, filed Mar. 18, 2019, each of which is incorporated herein by reference in its entirety.

TECHNICAL FIELD

A contact arrangement for a switching device and a switching device are specified.

SUMMARY

The switching device can be embodied, in particular, as a remotely actuated, electromagnetically acting switch, which can be operated by an electrically conductive current. The switching device can be activated via a control circuit and can switch a load circuit. In particular, the switching device can be designed as a relay or as a contactor, in particular as a power contactor. The switching device can particularly preferably be designed as a gas-filled power contactor.

One possible application of such switching devices, in particular of power contactors, is the opening and isolation of battery circuits, for example in motor vehicles such as electrically or partially electrically operated motor vehicles. These can be purely battery operated vehicles (BEV: battery electric vehicle), hybrid electric vehicles which can be charged via an outlet or charging station (PHEV: plug-in hybrid electric vehicle) and hybrid electric vehicles (HEV). In this case, both the positive and the negative contact of the battery are isolated with the aid of a power contactor. This disconnection takes place, for example, in a rest state of the vehicle in normal operation and also in the event of a disturbance such as an accident or the like. In this case, the main task of the power contactor is to switch the vehicle to a de-energized state and to interrupt the current flow.

Embodiments provide a contact arrangement for a switching device. Further embodiments provide a switching device.

According to at least one embodiment, the contact arrangement has a contact bridge. The contact arrangement can be, in particular, a contact arrangement for a switching device, wherein the contact bridge can be a movable contact of the switching device or part of a movable contact of the switching device. Properties and features of the movable contact, which are described below, can therefore be corresponding properties and features of the contact bridge, and vice versa. According to at least one further embodiment, a switching device has such a contact arrangement. The embodiments and features below apply equally to the contact arrangement and the switching device.

According to a further embodiment, the switching device has at least one fixed contact and at least one movable contact, which, as described above, can be formed in particular by the contact bridge of the contact arrangement or can have this contact bridge. The at least one fixed contact and the at least one movable contact are provided and configured to close and open a load circuit which can be connected to the switching device. The movable contact can be moved accordingly in the switching device between a non-interconnecting state and an interconnecting state of the switching device in such a way that the movable contact, i.e. in particular the contact bridge of the contact arrangement, is spaced, and therefore galvanically isolated, from at least one fixed contact in the non-interconnecting state of the switching device and is in mechanical contact with at least one fixed contact in the interconnecting state and is therefore galvanically connected to the at least one fixed contact.

The switching device particularly preferably has at least two fixed contacts, which are arranged isolated from one another in the switching device and which, in the manner described above, can be connected to one another in an electrically conductive manner, or electrically isolated from one another, by means of the movable contact, i.e. in particular the contact bridge, depending on the state of the movable contact, i.e. in particular the contact bridge. The contact bridge preferably has a top side with at least one contact region and a bottom side opposite the top side. In the interconnecting state of the switching device, the at least one contact region of the contact bridge is in mechanical contact with the at least one fixed contact, in particular a contact region of the at least one fixed contact. If the switching device has, for example, two fixed contacts, the contact bridge can accordingly have two contact regions.

Hereinafter, the general term "contacts" can refer, in particular, to all fixed contacts and to the contact bridge or the contact arrangement with the contact bridge. In particular, the contacts can comprise or be made of a metal, preferably copper or a copper alloy. Furthermore, a composite material in the form of a metallic matrix material, preferably containing or made of copper, and particles distributed therein, preferably containing or made of a ceramic material such as aluminum oxide, is, for example, also possible, at least for the contact regions.

According to a further embodiment, the switching device has a housing in which the contact arrangement and the at least one fixed contact or the at least two fixed contacts are arranged. The contact arrangement can be arranged, in particular, entirely in the housing. That a fixed contact is arranged in the housing can mean, in particular, that at least the contact region of the fixed contact, which is in mechanical contact with the movable contact in the interconnecting state, is arranged within the housing. In order to connect a supply line of a circuit to be switched by the switching device, a fixed contact arranged in the housing can be electrically contacted from the outside, i.e. from outside the housing. To this end, a fixed contact arranged in the housing can project out of the housing with one part and can have a connection option for a supply line outside the housing.

According to a further embodiment, the contacts are arranged in a gas atmosphere in the housing. This can mean, in particular, that the contact arrangement is arranged entirely in the gas atmosphere in the housing and that at least parts of the fixed contact or contacts, for instance the contact region or regions of the fixed contact or contacts, are arranged in the gas atmosphere in the housing. The switching device can accordingly particularly preferably be a gas-filled switching device, such as a gas-filled contactor.

According to a further embodiment, the contacts, meaning the contact arrangement in its entirety and at least parts of the fixed contact or contacts, are arranged in a switching chamber within the housing, in which the gas, i.e. at least part of the gas atmosphere, is located. The gas can preferably have a content of at least 20% $H_2$ and preferably at least 50% $H_2$. In addition to hydrogen, the gas can comprise an inert gas, particularly preferably $N_2$ and/or one or more noble gases.

According to a further embodiment, the contact arrangement in the switching device can be moved by means of an armature. To this end, the armature can, in particular, have a shaft which is connected to the contact arrangement at one end in such a way that the contact arrangement can be moved by means of the shaft, i.e. upon a movement of the shaft it is likewise moved thereby. The shaft can, in particular, project into the switching chamber through an opening in the switching chamber. The armature can be movable by a magnetic circuit in order to bring about the switching procedures described above. To this end, the magnetic circuit can have a yoke, which has an opening through which the shaft of the armature projects. The shaft can preferably comprise or be made of high-grade steel. The yoke can preferably comprise or be made of pure iron or a low-doped iron alloy.

According to a further embodiment, the contact arrangement has a retaining element on which the contact bridge is arranged. The contact bridge can furthermore be locked on the retaining element. In particular, the contact bridge is in a permanently locked state on the retaining element in the installed state of the contact arrangement in the switching device.

The retaining element can be fastened on the shaft, in particular in the installed state of the contact arrangement in the switching device. The retaining element can particularly preferably have a cylindrical hole with a cylinder axis, wherein the hole is provided and configured so that the retaining element can be arranged on the shaft and, in particular in the installed state of the contact arrangement in the switching device, is arranged on the shaft. The shaft can particularly preferably be arranged in the cylindrical hole of the retaining element in the installed state of the contact arrangement in the switching device. To this end, the shaft can be pushed into the hole of the retaining element. The shaft can particularly preferably be pushed through the hole so that the shaft projects out of the hole of the retaining element on both sides. The retaining element and therefore the contact arrangement can furthermore be locked on the shaft. This may be possible, for example, by means of a snap ring or riveting on the shaft. The retaining element and therefore the contact arrangement can moreover be screwed to the shaft. To this end, the retaining element can have a thread in the hole, with which the retaining element is screwed to a thread of the shaft. In this case, the retaining element can additionally be locked on the shaft, for example likewise by means of a snap ring and/or riveting and/or a check nut.

According to a further embodiment, the contact bridge is attached to the retaining element. In particular, the contact bridge, after the attachment to the retaining element, can be transferred to a locked state via a rotation around the cylinder axis of the hole of the retaining element. In the assembled state of the contact arrangement, the contact bridge can be in a locked state on the retaining element. This can mean, in particular, that the contact bridge is locked in a direction along the cylinder axis, i.e. it cannot be pulled off the retaining element. In the locked state, the retaining element and the contact bridge can therefore no longer be separated, although the contact bridge can be locked on the retaining element such that it is displaceable, in particular displaceable along the cylinder axis of the hole of the retaining element.

According to a further embodiment, the retaining element has an attachment part to which the contact bridge is attached. To this end, the contact bridge preferably has a hole through which the attachment part of the retaining element projects. This can mean, in particular, that, during the attachment of the contact bridge to the retaining element, the contact bridge is pushed onto the attachment part of the retaining element via the hole or, conversely, the attachment part of the retaining element is pushed into the hole of the contact bridge. In particular, the attachment part of the retaining element can project through the hole of the contact bridge after the attachment of the contact bridge. In particular, the contact bridge can furthermore also have a hole which has somewhat larger dimensions than the attachment part so that the contact bridge can be tiltably mounted on the attachment part.

According to a further embodiment, the attachment part has at least one retaining lug by means of which the contact bridge can be locked on the retaining element and which is arranged in the region of the top side of the contact bridge in the locked state. Owing to the at least one retaining lug, the contact bridge, in the locked state, can be prevented from being pulled off the retaining element along the direction of the cylinder axis of the hole of the retaining element. The hole of the contact bridge can furthermore have a hole wall with at least one insertion groove for the at least one retaining lug of the retaining element, wherein the at least one insertion groove reaches from the top side of the contact bridge to the bottom side. During the attachment, the contact bridge is aligned, in particular, such that it is rotated with respect to the retaining element so that the retaining lug can be pushed through the insertion groove. After the retaining lug has been pushed through entirely, the contact bridge is rotated relative to the retaining element around the cylinder axis of the hole of the retaining element so that the insertion groove and the retaining lug are aligned offset from one another.

According to a further embodiment, the contact bridge has, in the hole wall, at least one retaining groove which reaches from the top side of the contact bridge in the direction of the bottom side. In particular, the retaining groove does not reach as far as the bottom side. In the locked state of the contact bridge on the retaining element, the retaining lug is preferably located in the retaining groove. Rotating of the contact bridge relative to the retaining element can thus be prevented.

It can also furthermore be the case that the attachment part has two retaining lugs, which are arranged in a direction perpendicular to the cylinder axis on opposite sides of the attachment part. The contact bridge can accordingly have, in the hole wall, at least two insertion grooves, which are associated with the retaining lugs. The contact bridge can furthermore have, in the hole wall, retaining grooves associated with the at least two retaining lugs.

According to a further embodiment, the retaining element has a base part adjoining the attachment part, wherein the cylindrical hole of the retaining element reaches through the attachment part and the base part. The base part can preferably be shaped such that the base part does not fit through the hole of the contact bridge, at least in part, so that the base part can restrict the freedom of movement of the contact bridge in a direction along the cylinder axis of the hole of the retaining element. By way of example, the attachment part and the base part can each be designed to be cylindrical or substantially cylindrical in terms of their outer surfaces, wherein the base part has a larger diameter than the attachment part. In particular, the base part and the at least one retaining lug can result in a restriction of the freedom of movement, and therefore the locking of the contact bridge in both directions along the cylindrical axis of the hole of the retaining element.

According to a further embodiment, the contact arrangement furthermore has a contact spring, which is arranged on a bottom side of the contact bridge, which is remote from the at least one contact region. In particular, the contact spring can surround part of the retaining element, particularly preferably at least part of the base part. In the locked state of the contact bridge, the contact spring can be in direct contact with the bottom side of the contact bridge so that the bottom side of the contact bridge forms a counter bearing for the contact spring. The retaining element and, in particular, the base part can furthermore have a counter bearing for the contact spring on a side of the contact spring which is remote from the contact bridge. In other words, part of the base part can be designed as a counter bearing for the contact spring.

According to a further embodiment, the retaining element comprises an electrically insulating material. The retaining element is particularly preferably made of one or more electrically insulating materials so that the retaining element can be electrically insulating. The electrically insulating material or materials can be selected from polymers and ceramic materials, for example selected from polyoxymethylene (POM), in particular with the structure $(CH_2O)_n$, polybutylene terephthalate (PBT), glass fiber filled PBT and electrically insulating metal oxides, such as $Al_2O_3$. In particular, the retaining element can electrically insulate the contact bridge or preferably the contact bridge and the contact spring from the shaft. The contact bridge can thus be mounted such that it is electrically insulated from the components of the magnetic drive, i.e. in particular from the components of the armature. The retaining element can thus simultaneously enable mounting and locking of the contact bridge as well as electrical insulation of the contact bridge.

In the case of the contact arrangement described here, in particular at least one or more or all of the following advantages can be achieved according to the features described above:

- simple assemblability,
- use of fewer materials, which may entail low costs,
- full electrical insulation of the contact bridge from the shaft,
- thermal insulation of the contact bridge,
- flexible mounting and tiltability of the contact bridge,
- anti-rotation protection of the contact bridge with respect to the retaining element, and/or
- anti-rotation protection of the retaining element and therefore the contact arrangement with respect to the switching chamber and the fixed contacts.

BRIEF DESCRIPTION OF THE DRAWINGS

Further advantages, advantageous embodiments and developments are revealed in the exemplary embodiments described below in association with the figures.

DETAILED DESCRIPTION OF ILLUSTRATIVE EMBODIMENTS

In the exemplary embodiments and figures, identical, similar or identically acting elements may each be denoted by the same reference signs. The elements illustrated and their mutual proportions should not be considered true to scale; instead, individual elements, for example layers, components, structural elements and regions, may be shown exaggerated in size for better illustration and/or for better understanding.

Figure 1:
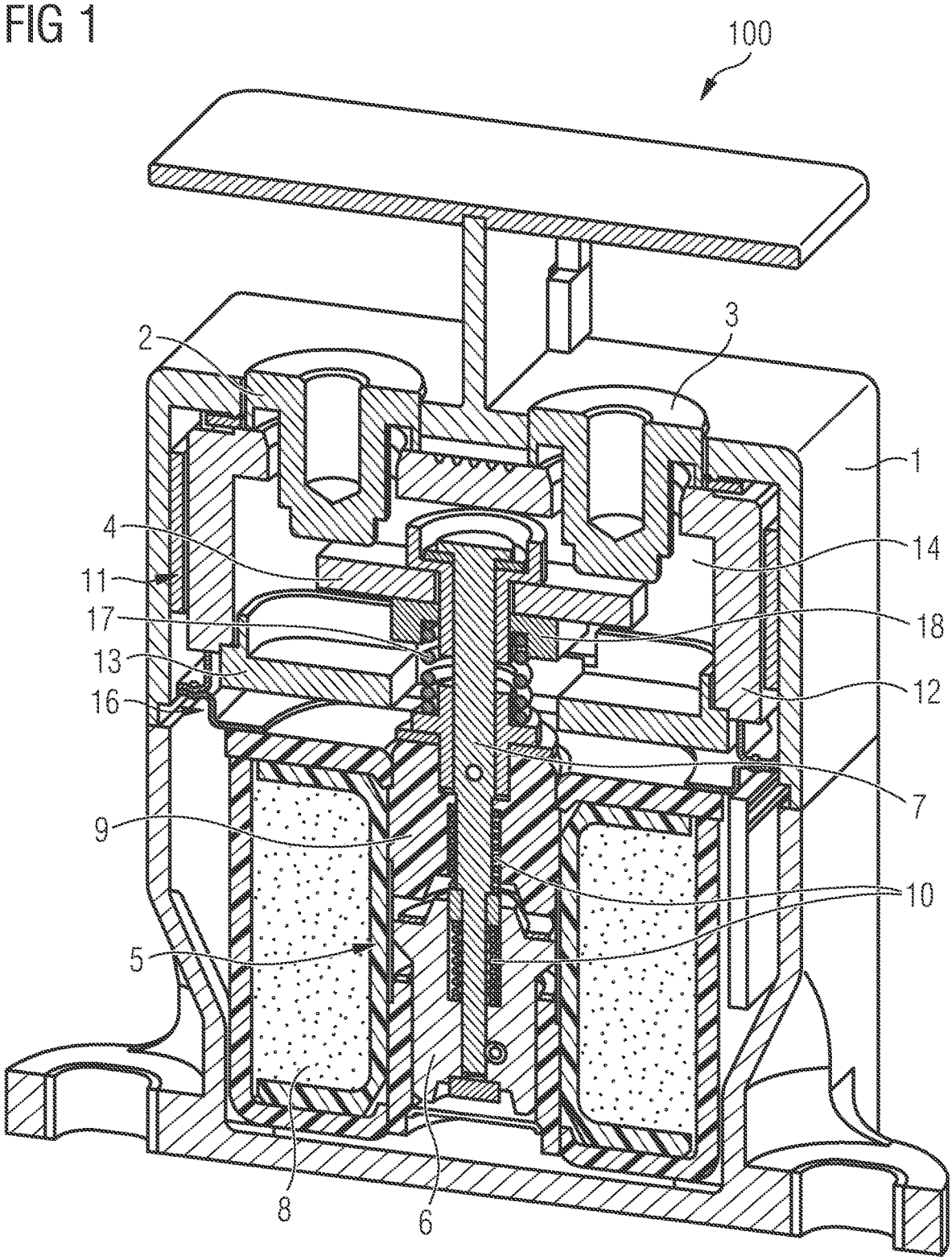
FIG. 1 shows a schematic illustration of a switching device.

In FIG. 1, a switching device 100 is shown, which can be used, for example, for switching high electric currents and/or high electric voltages and which can be a relay or contactor, in particular a power contactor. The geometries shown should be regarded as merely exemplary and non-restrictive and may also be designed in an alternative manner.

The switching device 100 has, in a housing 1, two fixed contacts 2, 3 and a movable contact in the form of a contact bridge 4. The contact bridge 4 is designed as a contact plate. The fixed contacts 2, 3 form the switching contacts together with the contact bridge 4. Alternatively to the number of contacts shown, different numbers of fixed and/or movable contacts may also be possible. The housing 1 serves primarily as touch-protection for the components arranged in the interior and comprises or is made of a plastic, for example PBT or glass fiber filled PBT. The fixed contacts 2, 3 and the contact bridge 4 can, for example, contain or be made of Cu, a Cu alloy or a mixture of copper and at least one further metal, for example W, Ni and/or Cr.

In FIG. 1, the switching device 100 is shown in a rest state, in which the contact bridge 4 is spaced from the fixed contacts 2, 3 so that the fixed contacts 2, 3 and the contact bridge 4 are galvanically isolated from one another. The embodiment shown of the switching contacts and, in particular, the geometry thereof should be regarded as purely exemplary and non-restrictive. Alternatively, the switching contacts can also have a different design. By way of example, it may be possible that only one of the switching contacts is designed in a fixed manner.

The switching device 100 has a movable armature 5, which substantially performs the switching movement. The armature 5 has a magnetic core 6, for example containing or made of a ferromagnetic material. The armature 5 furthermore has a shaft 7, which is guided through the magnetic core 6 and is fixedly connected to the magnetic core 6 at one shaft end. At the other shaft end, which is opposite the magnetic core 6, the armature 5 has the contact bridge 4, which is connected to the shaft 7, or mounted thereon, in such a way that the contact bridge 4 reproduces the movements of the shaft 7. The shaft 7 can preferably be manufactured such that it contains or is made of high-grade steel.

The magnetic core 6 is surrounded by a coil 8. A current flow in the coil 8, which can be switched on by the control circuit, generates a movement of the magnetic core 6 and therefore the entire armature 5 in the axial direction until the contact bridge 4 contacts the fixed contacts 2, 3. In the illustration shown, the armature moves upwards. The armature 5 therefore moves from a first position which corresponds to the rest position shown and, at the same time, the isolating, i.e. non-interconnecting and therefore open, state into a second position which corresponds to the active, i.e. interconnecting and therefore closed, state. In the active state, the fixed contacts 2, 3 and the contact bridge 4 are galvanically connected to one another. If the current flow in the coil 8 is interrupted, the armature 5 is moved back into the first position by one or more springs 10. In the illustration shown, the armature 5 therefore moves downwards again. The switching device 100 is then located in the rest state again, in which the switching contacts are opened.

When the switching contacts are opened, an arc can be formed which can damage the contact surfaces. This can create the risk of at least one of the fixed contacts 2, 3 and the contact bridge 4 remaining "adhered" to one another as a result of the welding caused by the arc and no longer being isolated from one another. In this case, the switching device therefore also remains in the closed state when the current in the coil is switched off and the load circuit should therefore be isolated. In order to prevent the formation of such arcs or to at least promote the extinguishing of arcs which form, the fixed contacts 2, 3 and the contact bridge 4 are arranged in a gas atmosphere so that the switching device 100 is designed as a gas-filled relay or gas-filled contactor. To this end, the fixed contacts 2, 3 and the contact bridge 4 within a switching chamber 11 formed by a switching chamber wall 12 and a switching chamber base 13 are arranged in a gas-tight region 16 formed by a hermetically sealed part. The gas-tight region 16 surrounds the armature 5 and the switching contacts entirely, with the exception of parts of the fixed contacts 2, 3 which are provided for the external connection. The gas-tight region 16 and therefore also the switching chamber 11 are filled with a gas 14. The gas-tight region 16 is formed substantially by parts of the switching chamber 11, the yoke 9 and additional walls. The gas 14 with which the gas-tight region 16 can be filled via a gas fill nozzle (not shown) during the production of the switching device 100 can particularly preferably contain hydrogen, for example containing at least 20% or at least 50% or more $H_2$ in an inert gas or even with 100% $H_2$ since hydrogen-containing gas can promote the extinguishing of arcs. So-called blow magnets (not shown) can furthermore be present within or outside the switching chamber 11, i.e. permanent magnets which bring about an elongation of the arc path and can therefore improve the extinguishing of the arcs. The switching chamber wall 12 and the switching chamber base 13 can be manufactured, for example, such that they contain or are made of a metal oxide, such as $Al_2O_3$. Plastics with a sufficiently high temperature resistance are furthermore also suitable, for example a PEEK, a PE and/or a glass fiber filled PBT. Alternatively or additionally, the switching chamber 11 can also at least partially comprise a POM, in particular with the structure $(CH_2O)_n$.

In order to be able to compensate height differences during the switching of the contact bridge 4 and to achieve an adequate mechanical contact between the fixed contacts 2, 3 and the contact bridge 4, a contact spring 17 is arranged below the contact bridge 4, which contact spring exerts a force on the contact bridge 4 in the direction of the fixed contacts 2, 3. A counter bearing for the end of the contact spring 17 which is remote from the contact bridge 4 is arranged in the region of the yoke 9. At the other end of the contact spring 17, a further spring bearing 18 made of an electrically insulating material is additionally arranged between the contact bridge 4 and the contact spring 17. Electrical insulation between the contact bridge 4 and further components such as the contact spring 17, the shaft 7 and other electrically conductive components can thus be achieved. Such electrical insulation is necessary since, during operation, high voltages can occur in certain applications between the load circuit and the control circuit. The insulation requirements in this regard are generally in the range of 2400 VAC to 5000 VAC or even higher voltages. Without adequate electrical insulation between the load circuit, i.e. in particular the contact bridge, and the control circuit, flashovers can occur in the control circuit network, which represents a high safety risk. Alternatively to insulation by means of an additionally applied insulating element such as the spring bearing described and/or other suitable additional insulator elements, it is also known in the prior art to cast the coil with insulation material, for example. However, the insulation measures are generally complex and increase the production and manufacturing costs.

In association with the following figures, exemplary embodiments for a contact arrangement 200 and a switching device 100 with such a contact arrangement 200 are explained, which, amongst other things, offer the advantages of simple assemblability and the use of fewer materials and fewer components. Moreover, due to the design of the contact arrangement 200, it is possible to insulate the contact bridge 4 both electrically and thermally without requiring the presence of an additional insulating spring bearing between the contact spring and the contact bridge, as explained in association with FIG. 1. The contact arrangement 200 explained below can furthermore enable a flexible bearing and a tiltability of the contact bridge 4 as well as anti-rotation protection for both the contact bridge 4 with respect to the contact arrangement 200 and the contact arrangement 200 with respect to the switching chamber 11 and the fixed contacts 2, 3.

Figure 2A:
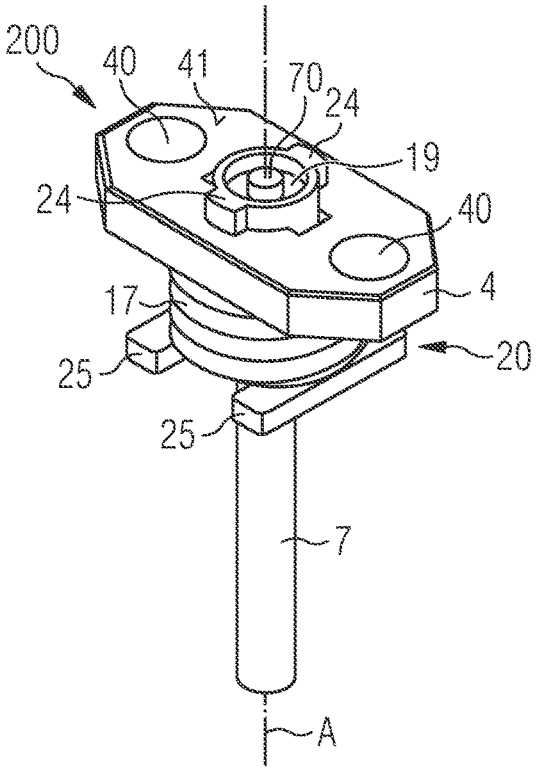
FIGS. 2A to 2E show schematic illustrations of a contact arrangement for a switching device according to an exemplary embodiment.
Figure 2B:
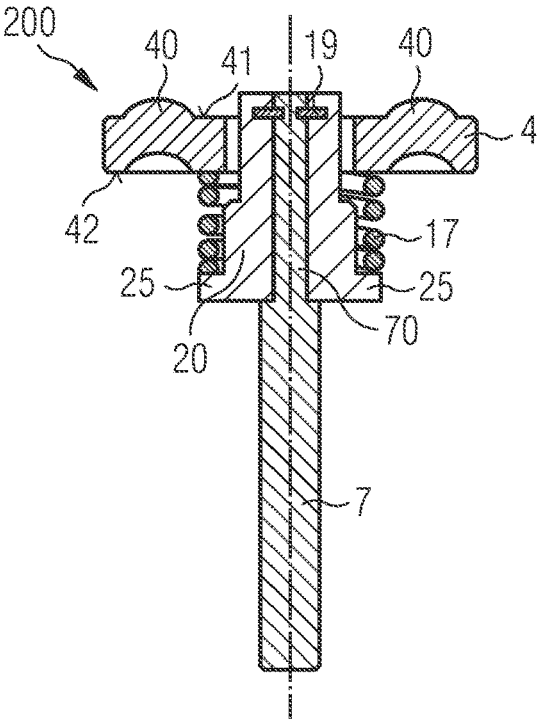
Figure 2C:
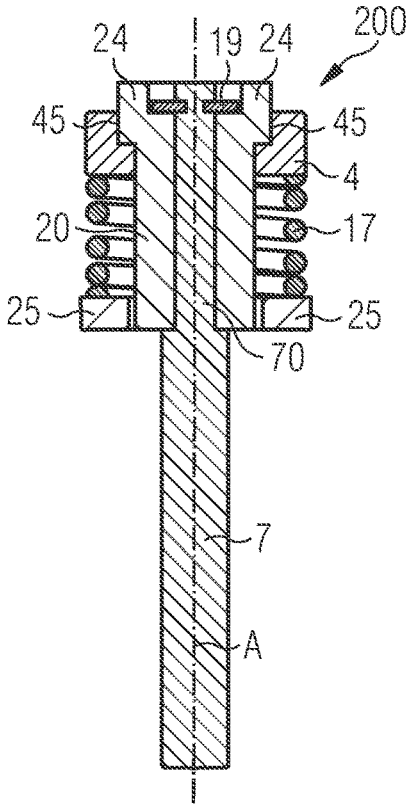
Figure 2D:
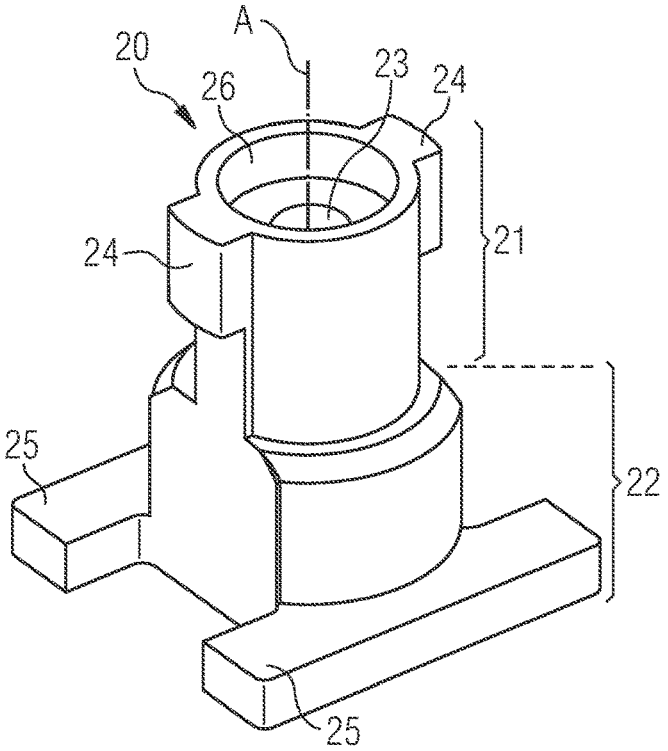
Figure 2E:
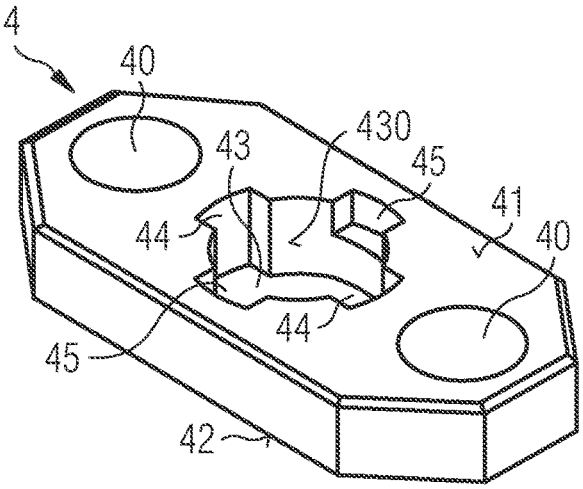

In association with FIGS. 2A to 2E, an exemplary embodiment for the contact arrangement 200 for a switching device is shown, wherein, with the exception of the features described below, the switching device can be designed in the same way as the switching device described in association with FIG. 1. FIGS. 2A to 2C show a schematic three-dimensional illustration and mutually perpendicular schematic sectional illustrations of the contact arrangement 200 with a retaining element 20 and a contact bridge 4, whilst the retaining element 20 and the contact bridge 4 are each shown individually in a schematic three-dimensional illustration in FIGS. 2D and 2E. The description below relates equally to FIGS. 2A to 2E.

The shaft 7 of the switching device is additionally shown in FIGS. 2A to 2C in order to clarify the arrangement of the contact arrangement 200 on the shaft 7 and therefore in the switching device. The retaining element 20 has a cylindrical hole 23 with a cylinder axis A, which is provided and configured so that the retaining element 20 can be arranged on the shaft 7 and, in particular in the installed state of the contact arrangement in the switching device, is arranged on the shaft 7. In particular, in the installed state in the switching device, the shaft 7 is pushed in the cylindrical hole 23 via an upper region 70 which forms the end of the shaft 7 which is remote from the magnetic core. In this case, the shaft 7 can be pushed through the hole 23 so that the shaft 7 can project out of the hole 23 of the retaining element 20 on both sides. As can be seen in FIGS. 2B and 2C, the shaft 7 can have a smaller diameter in the region 70 than in the remaining extent of the shaft 7, wherein the diameter of the region 70 is adapted to the internal diameter of the cylindrical hole 23 and is substantially the same as this so that the shaft 7 has a step on which the retaining element 20 and therefore the contact arrangement 200 is seated after the shaft 7 has been pushed into the hole 23. In the installed state in the switching device, the retaining element 20 and therefore the contact arrangement 200 can furthermore be locked on the shaft 7, for example by means of a snap ring 19 as shown and/or by means of riveting on the shaft 7, for example. In the latter case, the shaft 7 can be deformed in the region above the snap ring 19, or a washer can be used instead. As shown, the retaining element 20 can have, in the upper region, adjoining the hole 23, a recess 26 into which the shaft 7 projects and in which the snap ring 19 and/or riveting can be arranged.

In the exemplary embodiment shown, corresponding to the design of the switching device shown in FIG. 1, the contact bridge 4 has two contact regions 40 on a top side 41 for the purpose of contacting the fixed contacts of the switching device. As can be seen in FIG. 2B, recesses can be present below the contact regions 40 on the bottom side 42 of the contact bridge 4, which is opposite the top side 41. Alternatively to this, the bottom side 42 can also be designed to be planar in these regions.

The contact bridge 4 is attached to the retaining element 20 and locked thereon, at least in the installed state of the contact arrangement 200 in the switching device, on the retaining element 20. After the attachment, the locking takes place as described below via a rotation of the contact bridge 4 around the cylinder axis A of the hole 23. That the contact bridge 4 is in a locked state means, in particular, that the contact bridge 4 is locked in a direction along the cylinder axis A and therefore cannot be pulled off the retaining element 20. In the locked state, the retaining element 20 and the contact bridge 4 can therefore no longer be separated, although the contact bridge 4 can be displaceable along the cylinder axis A of the hole 23 of the retaining element 20.

The retaining element 20 has an attachment part 21 to which the contact bridge 4 is attached. To this end, the contact bridge 4 has a hole 43 through which the attachment part 21 projects after the attachment. In particular, during the attachment of the contact bridge 4 to the retaining element 20, the contact bridge 4 is pushed onto the attachment part 21 via the hole 43 or, conversely, the attachment part 21 is pushed into the hole 43. The hole 43 of the contact bridge 4 particularly preferably has somewhat larger dimensions than the attachment part 21 so that the contact bridge 4 can be displaceably and at least partially tiltably arranged on the attachment part 21.

The attachment part 21 has at least one retaining lug 24. In the exemplary embodiment shown, the attachment part 21 has two retaining lugs 24, which are arranged on mutually opposite sides of the attachment part 21 in a direction perpendicular to the cylinder axis A. Alternatively to this, different numbers of retaining lugs are also possible. The locking of the contact bridge 4 on the retaining element 20 in a direction along the cylinder axis A is brought about by means of the retaining lugs 24. In the locked state, the retaining lugs 24 are arranged in the region of the top side 41 of the contact bridge 4. In particular, the contact bridge 4 can abut against the retaining lugs 24 in the assembled state of the contact arrangement 200. To enable the attachment of the contact bridge 4 to the attachment part 21, the hole 43 of the contact bridge 4 has, in the hole wall 430 surrounding the hole 43, one or more insertion grooves 44 corresponding to the number and position of the retaining lugs 24, which insertion grooves reach from the top side 41 of the contact bridge 4 to the bottom side 42. In the exemplary embodiment shown, the contact bridge accordingly has, in the hole wall 430, two insertion grooves 44 which are associated with the retaining lugs 24 and whereof the dimensions are such that the retaining lugs 24 can be pushed through the insertion grooves 44. During the attachment, the contact bridge 4 is aligned with respect to the retaining element 20 such that the attachment part 21 with the retaining lugs 24 can be pushed through the hole 43 with the insertion grooves 44. After the retaining lugs 24 have been pushed through entirely, the contact bridge 4 is rotated relative to the retaining element 20 around the cylinder axis A of the hole 23 of the retaining element 20 so that the insertion grooves 44 and the retaining lugs 24 are aligned offset from one another.

The contact bridge 4 in the exemplary embodiment shown furthermore has, in the hole wall 430, one or more retaining grooves 45 corresponding to the number and position of the retaining lugs 44, which retaining grooves reach from the top side 41 of the contact bridge 4 in the direction of the bottom side 42, but not as far as this bottom side. In the exemplary embodiment shown, the contact bridge 4 accordingly has two retaining grooves 45. During the locking of the contact bridge 4, this is rotated to the extent that the retaining lugs 24 can be arranged in the retaining grooves 45. Rotating of the contact bridge 4 relative to the retaining element 20 can thus be prevented. The retaining lugs 24 can be linear, rounded or angled on the side facing the bottom side 42 of the contact bridge 4 in order to promote or reduce the tiltability of the contact bridge 4 depending on the desired design. The mobility of the contact bridge 4 can therefore be suitably selected via a suitable form of the retaining lugs 24 so that the contact bridge 4 can function as a type of rocker. Height differences during switching can thus be prevented as a result of the tiltability.

On the side opposite the retaining lugs 24, the retaining element 20 has a base part 22 adjoining the attachment part 21, wherein the cylindrical hole 23 of the retaining element 20 reaches through the attachment part 21 and the base part 22. The base part 22 is shaped such that the base part 22 does not fit through the hole 43 of the contact bridge 4 so that the base part 22 restricts the freedom of movement of the contact bridge 4 in a direction along the cylinder axis A. As can be seen in particular in FIG. 2D, the attachment part 21 and the base part 22 can each be designed to be cylindrical or substantially cylindrical in terms of their outer surfaces, wherein the base part 22 has a larger diameter than the attachment part 21.

As shown in FIGS. 2A to 2C, the contact arrangement 200 furthermore has a contact spring 17, which is arranged on the bottom side 42 of the contact bridge 4. In particular, the contact spring 17, in the locked state of the contact bridge 4 on the retaining element 20, can be in direct contact with the bottom side 42 of the contact bridge 4 so that the bottom side 42 of the contact bridge 4 forms a counter bearing for the contact spring 17. The retaining element 20 and, in particular, the base part 22 can furthermore have a counter bearing 25 for the contact spring 17 on a side of the contact spring 17 which is remote from the contact bridge 4. The contact spring 17 surrounds part of the base part 22 as shown.

During the assembly of the contact arrangement 200, the retaining element 20 can firstly be connected to the shaft 7 in the manner described above. The contact spring 17 can then be seated and the contact bridge 4, in the manner described above, can be pushed onto the attachment part 21, rotated through an angle of 90° with respect to the final installation position, and locked via a rotation through an angle of 90°.

The retaining element comprises an electrically insulating material. The retaining element is particularly preferably manufactured from one or more electrically insulating materials and is therefore electrically insulating as a whole. The electrically insulating material or materials can be selected from polymers and ceramic materials, for example selected from polyoxymethylene (POM, polybutylene terephthalate (PBT), glass fiber filled PBT and electrically insulating metal oxides, such as $Al_2O_3$. As a result of the design shown of the retaining element 20, the retaining element 20 can electrically insulate the contact bridge 4 or preferably the contact bridge 4 and the contact spring 17 from the shaft 17. The contact bridge 4 can thus be mounted such that it is electrically insulated from the components of the magnetic drive of the switching device, i.e. in particular from the components of the armature. There is therefore no conductive contact between the contact bridge 4 and the shaft 7. All possible arc paths can be taken into account with long clearance and creepage distances. The retaining element therefore simultaneously enables mounting and locking of the contact bridge 4 as well as electrical insulation of the contact bridge 4.

Figure 3:
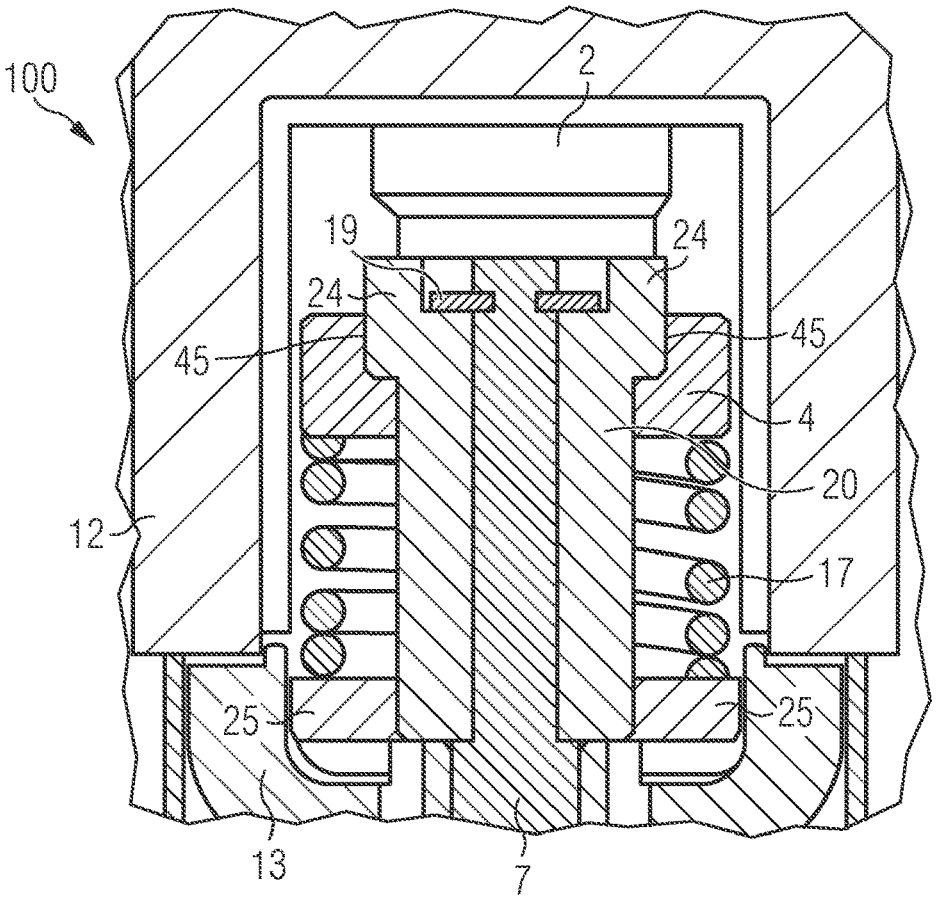
FIG. 3 shows a schematic illustration of a detail of a switching device according to a further exemplary embodiment.

In FIG. 3, a detail of a switching device 100 is shown in a sectional illustration corresponding to FIG. 2C, which can be designed in the same way as the switching device described in association with FIG. 1, wherein, in contrast to FIG. 1, the contact arrangement 200 is installed according to the previous exemplary embodiment. Components and features of the switching device which are not shown and/or described in association with FIG. 3 can be designed as described in association with FIG. 1.

The counter bearing 25 of the base part of the retaining element 20 can, as shown, additionally enable support against the switching chamber 11 as a result of the elongated design on both sides and can therefore ensure anti-rotation protection of the contact arrangement 200 in the switching device 100 since even small rotations are no longer possible. As a result of the form shown of the base part of the retaining element 20, a guidance of the entire contact arrangement 200 during the upward and downward movement during the switching procedures can therefore be enabled.

Figure 4A:
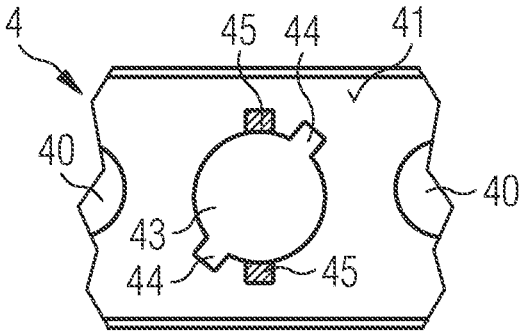
FIGS. 4A and 4B shows schematic illustrations of details of contact bridges according to further exemplary embodiments.
Figure 4B:
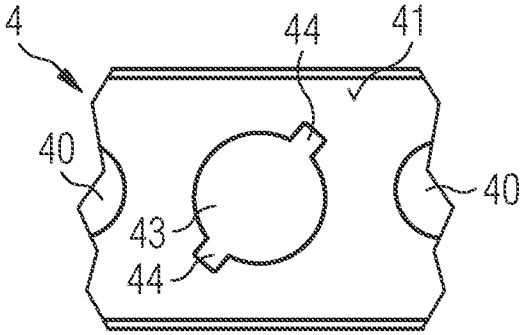

In FIGS. 4A and 4B, schematic illustrations of details of contact bridges 4 according to further embodiments are each shown in a plan view of the top side 41. In contrast to the exemplary embodiment of FIGS. 2A to 2E, in which the insertion grooves 44 and the retaining grooves 45 are arranged in the hole 43 of the contact bridge 4 such that they are offset from one another through an angle of 90°, another angle may also be possible, as shown in FIG. 4A. Purely by way of example, an angle of 45° is shown. As shown in FIG. 4B, it may also be possible that retaining grooves are not present and the retaining lugs of the retaining elements are supported on the planer top side 41 of the contact bridge 4.

Figure 5:
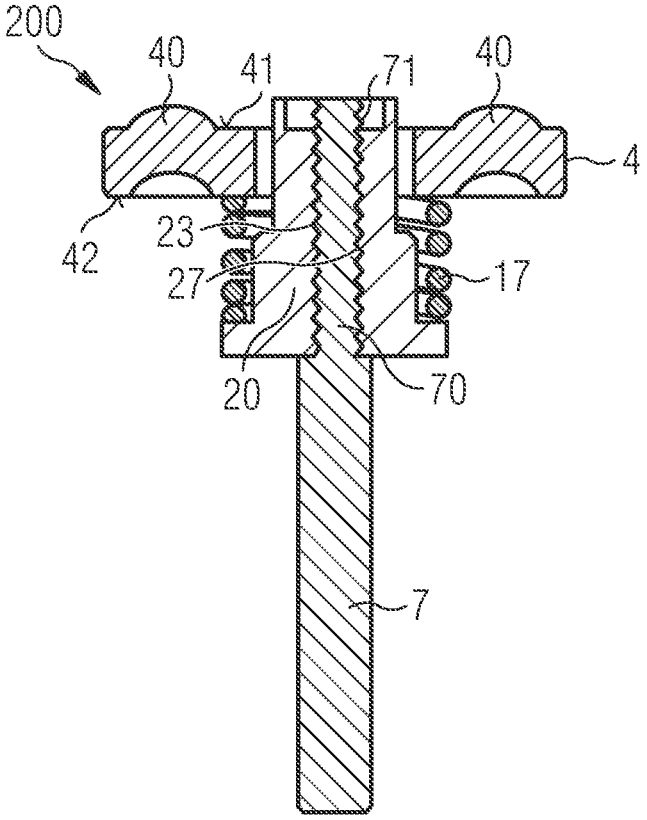
FIG. 5 shows a schematic illustration of a contact arrangement according to a further exemplary embodiment.

In FIG. 5 a contact arrangement 200 according to a further exemplary embodiment is shown, in which, in contrast to the exemplary embodiment of FIGS. 2A to 2E, the retaining element 20 and therefore the contact arrangement 200 can be screwed to the shaft 7. To this end, the retaining element 20 has a thread 27 in the hole 23. The switching device in which the contact arrangement 200 is installed has a shaft 7, which is likewise shown in FIG. 5 and which has, in the region 70, a corresponding thread 71 to which the retaining element 20 is screwed. During installation in the switching device, the retaining element 20 can additionally be locked on the shaft 7 as described in association with the exemplary embodiment of FIGS. 2A to 2E, for example by means of a snap ring, riveting or, owing to the thread 71, by means of a check nut.

The features and exemplary embodiments described in association with the figures can be combined with one another according to further exemplary embodiments, even if not all combinations have been explicitly described. The exemplary embodiments described in association with the figures can furthermore alternatively or additionally have further features according to the description in the general part.

The description based on the exemplary embodiments does not restrict the invention thereto. Instead, the invention comprises any novel feature and any combination of features, which, in particular, includes any combination of features in the claims, even if this feature or this combination itself is not explicitly specified in the claims or exemplary embodiments.

The invention claimed is:

1. A contact arrangement comprising:

a retaining element with a cylindrical hole having a cylinder axis configured to arrange the retaining element on a shaft; and a contact bridge attached to the retaining element, wherein the contact bridge has a top side with at least one contact region and a bottom side opposite the top side, and wherein, via a rotation around the cylinder axis, the contact bridge is transferable to a locked state on the retaining element in a direction along the cylinder axis.

2. The contact arrangement according to claim 1, wherein the contact bridge has a hole through which an attachment part of the retaining element projects.

3. The contact arrangement according to claim 2, wherein the attachment part has at least one retaining lug configured to lock the contact bridge on the retaining element, and wherein the at least one retaining lug arranged in a region of the top side of the contact bridge in the locked state.

4. The contact arrangement according to claim 3, wherein the hole of the contact bridge has a hole wall with at least one insertion groove for the at least one retaining lug of the retaining element and the at least one insertion groove reaches from the top side of the contact bridge to the bottom side.

5. The contact arrangement according to claim 3, wherein the contact bridge has, in a hole wall, at least one retaining groove, which reaches from the top side of the contact bridge in a direction of the bottom side.

6. The contact arrangement according to claim 3, wherein the attachment part has two retaining lugs, which are arranged on mutually opposite sides of the attachment part in a direction perpendicular to the cylinder axis, and wherein the contact bridge has, in a hole wall, insertion grooves which are associated with the at least two retaining lugs.

7. The contact arrangement according to claim 6, wherein the contact bridge has, in the hole wall, retaining grooves associated with the at least two retaining lugs.

8. The contact arrangement according to claim 2, wherein the retaining element has a base part adjoining the attachment part and the cylindrical hole reaches through the attachment part and the base part.

9. The contact arrangement according to claim 1, further comprising a contact spring arranged on the bottom side of the contact bridge, the bottom side being remote from the at least one contact region.

10. The contact arrangement according to claim 9, wherein the contact spring surrounds at least part of the base part.

11. The contact arrangement according to claim 9, wherein the contact spring, in the locked state of the contact bridge on the retaining element, is in direct contact with the bottom side of the contact bridge and the bottom side of the contact bridge forms a counter bearing for the contact spring.

12. The contact arrangement according to claim 9, wherein the retaining element has a counter bearing for the contact spring on a side of the contact spring remote from the contact bridge.

13. A switching device comprising:

at least one fixed contact and the contact arrangement according to claim 1 in a switching chamber, wherein the contact arrangement is movable by an armature with the shaft, and wherein the shaft is arranged in the cylindrical hole of the retaining element.

14. The switching device according to claim 13, wherein a snap ring or a riveting is configured to lock the retaining element of the contact arrangement on the shaft.

15. The switching device according to claim 13, wherein the retaining element has, in the hole of the retaining element, a thread with which the retaining element is screwed to a thread of the shaft.

* * * * *